US006841288B2

(12) United States Patent
Håkansson et al.

(10) Patent No.: US 6,841,288 B2
(45) Date of Patent: Jan. 11, 2005

(54) METHOD AND CONSTRUCTION FOR VENTILATION OF HYDROGEN GAS

(75) Inventors: Bo Håkansson, Sundsvall (SE); Eduardo Fontes, Sundsvall (SE); Magnus Davidsson, Sundsvall (SE); Hans-Göran Sundström, Sundsvall (SE); Lars Blomgren, Ånge (SE); Arne Carlsson, Columbus, MS (US)

(73) Assignee: Akzo Nobel N.V., Arnhem (NL)

( * ) Notice: Subject to any disclaimer, the term of this patent is extended or adjusted under 35 U.S.C. 154(b) by 215 days.

(21) Appl. No.: 09/741,739

(22) Filed: Dec. 21, 2000

(65) Prior Publication Data

US 2001/0022275 A1 Sep. 20, 2001

Related U.S. Application Data

(60) Provisional application No. 60/173,246, filed on Dec. 28, 1999.

(30) Foreign Application Priority Data

Dec. 28, 1999 (EP) ..... 99850218

(51) Int. Cl.[7] ..... H01M 8/04
(52) U.S. Cl. ..... 429/39; 429/34; 204/252
(58) Field of Search ..... 204/252, 254, 204/288.2, 196.08; 429/210, 34, 39; 95/11; 405/211, 211.1; 205/501, 505, 510, 511

(56) References Cited

U.S. PATENT DOCUMENTS

| | | | | |
|---|---|---|---|---|
| 3,137,937 A | | 6/1964 | Cowan | 29/486 |
| 3,992,279 A | | 11/1976 | Larsson | 204/288 |
| 3,999,699 A | * | 12/1976 | Chisholm | 288/173.5 |
| 4,116,807 A | | 9/1978 | Peters | 204/290 |
| 4,340,452 A | * | 7/1982 | deNora | 205/525 |
| 4,444,632 A | * | 4/1984 | deNora | 205/513 |
| 4,444,641 A | * | 4/1984 | Oda et al. | 204/284 |
| 4,668,371 A | * | 5/1987 | Pimlott et al. | 204/253 |
| 5,047,602 A | * | 9/1991 | Lipka | 200/86 R |
| 5,599,430 A | * | 2/1997 | Pimlott et al. | 204/252 |
| 5,850,591 A | * | 12/1998 | Sugikawa | 428/553 |
| 6,309,546 B1 | * | 10/2001 | Herrmann et al. | 210/500.25 |

FOREIGN PATENT DOCUMENTS

| | | |
|---|---|---|
| CA | 914610 | 11/1972 |
| DE | 2656109 | 6/1977 |
| DE | 3121799 A1 | 12/1982 |
| GB | 2135696 A | 9/1984 |

OTHER PUBLICATIONS

Derwent Info Ltd., English language Abstract of DE 3121799.

Derwent Info Ltd., English language, Abstract of DE 2656109.

A. Gonzalez, J.D. Cuyas, G. Cusminsky, "Explosive Welding of Aluminium and Aluminium Alloy Sheet Composites; Steel Mesh Reinforced," 7th International Conference on High Energy Rate Fabrication, Sep. 14–18, 1981, pp. 199–207.

* cited by examiner

*Primary Examiner*—Carol Chaney
(74) *Attorney, Agent, or Firm*—David J. Serbin

(57) ABSTRACT

The invention relates to a construction for ventilation of hydrogen gas comprising at least a first metallic layer (1), sensitive to hydrogen embrittlement, a second (2) metallic layer, and a mesh (4), wherein the first layer (1) is joined to the second layer (2), and said mesh (4), forming venting channels (5) through which channels (5) hydrogen can be vented, is joined to, and in between, said first (1) and second (2) metallic layers. The invention further concerns a method for production thereof.

9 Claims, 1 Drawing Sheet

METHOD AND CONSTRUCTION FOR VENTILATION OF HYDROGEN GAS

This application claims the benefit of U.S. provisional application No. 60/173,246 filed Dec. 28, 1999.

The present invention relates to a construction for ventilation of hydrogen gas and a method for production thereof. More specifically, the invention relates to a construction comprising at least a first and a second metallic layer joined together and a mesh joined to, and in between, said layers. The construction comprising the mesh imparts ventilation channels between the mesh and the layers thereby preventing formation of hydrogen blisters and reducing the hydrogen embrittlement of the first layer.

BACKGROUND OF THE INVENTION

Many metals used in constructions in contact with hydrogen are sensitive to hydrogen, e.g. such used in electrochemical cells for production of alkali metal chlorate. Various solutions have been proposed to overcome this problem.

U.S. Pat. No. 3,992,279 discloses an electrode assembly comprising a Ti-based anode, a cathode, of an iron-based material, and an intermediate layer, of silver or gold, in between said anode and cathode. In an electrolytic cell, e.g. for production of sodium chlorate from sodium chloride, a portion of adsorbed atomic hydrogen deriving from the cathodic reaction at the cathode will start to diffuse from the cathode through the electrode assembly towards the hydrogen-sensitive anode, i.e. the titanium layer. The intermediate layer of the electrode provides for a hydrogen barrier which blocks the flow of hydrogen thereby providing protection of the hydrogen sensitive anode. CA 914,610 also discloses an electrolytic cell assembly, of a multi-monopolar cell, comprising a cathode-intermediate layer-anode structure.

However, in U.S. Pat. No. 3,992,279, atomic hydrogen will recombine to hydrogen gas at the interface zone, i.e. the joint between the cathode and the intermediate layer. This may lead to formation of hydrogen blisters which, in turn, will reduce the strength of the cathode-intermediate layer joint of the electrode assembly as a consequence of the increased pressure which may cause separation thereof.

U.S. Pat. No. 4,116,807 shows one concept of how the formation of hydrogen blisters can be prevented. It discloses a method for connecting, by use of explosion bonding, anode and cathode backplates, carrying an anode and a cathode, to metallic strip conductors, thereby forming an air space between the backplates, which in turn allows hydrogen gas to escape. Explosion bonding, or explosive welding, as such, has been known for a long time to join and reinforce metal constructions. This is described in e.g. an article by Gonzalez, A. et al. pages 199–207 "Explosive welding of Aluminium and Aluminium Alloy Sheet Composites", $7^{th}$ International Conference on High energy rate fabrication, Sep. 14–18, 1981, in which aluminium constructions are reinforced with steel meshes. Explosive bonding technique is also described in U.S. Pat. No. 3,137,937.

In assemblies as described in U.S. Pat. No. 4,116,807, however, the explosion bonded backplates are difficult and complicated to manufacture due to the difficulties to distribute energy evenly on the surface on which the strips are placed. The strips can therefore also be difficult to explosion bond at specific fixed points on the backplates. Another drawback with this type of embodiments is that the connection area, which is unventilated, between the strips and the backplates must be considerably large to guarantee good strength and good electrical contact. Further, these types of electrode constructions are only applicable to multimonopolar cells and cell lines, i.e. cells in which the backplates are placed between the cells.

THE INVENTION

The above problems have been overcome by the present invention as defined by the appended claims.

The invention concerns a method for ventilation of hydrogen gas comprising joining a first metallic layer, sensitive to hydrogen embrittlement, to a second metallic layer, and a mesh. The first layer is joined to the second layer, and said mesh, forming venting channels through which channels hydrogen can be vented, is joined to, and in between, said first and second metallic layers.

The invention also concerns a method for producing a construction comprising at least two metallic layers, by joining a first metallic layer, sensitive to hydrogen embrittlement, to a second metallic layer, and a mesh. The first metallic layer is joined to the second metallic layer, and said mesh is joined to, and in between, the first and the second metallic layers.

Suitably, the first metallic layer is selected from Fe, steel, Ti, Zr, Nb, Ta or other valve metals or alloys thereof. The thickness of the first metallic layer is suitably from about 1 to about 20 mm, preferably from about 1 to about 15 mm.

Suitably, the second metallic layer is selected from Fe, steel, Ni, Cr, W, or alloys thereof, preferably from Fe, steel, Ni, or alloys thereof. The thickness of the second metallic layer is suitably from about 2 to about 30 mm, preferably from about 5 to about 20 mm.

The joining of the layers is suitably accomplished by means of explosion bonding, rolling, bolting or the like. Preferably, explosion bonding is employed.

According to one preferred embodiment, the invention relates to a method for ventilation of hydrogen gas comprising joining a first metallic layer, sensitive to hydrogen embrittlement, to a second and a third metallic layer, and a mesh. The first layer is joined to the third layer, the third layer is joined to the second layer, and said mesh, forming venting channels, through which channels hydrogen can be vented, is joined to, and in between, said second and third metallic layers.

According to this same preferred embodiment, the invention also relates to a method for producing a construction comprising at least three metallic layers by joining a first metallic layer sensitive to hydrogen embrittlement to a second and a third metallic layer, and a mesh. The first metallic layer is joined to the third metallic layer, the third metallic layer is joined to the second metallic layer, and said mesh is joined to, and in between, the second and the third metallic layers. The joining of the third layer is suitably performed by means of the joining methods as above described.

The at least three metallic layers can be joined together in any order. For example, the first metallic layer can first be joined to the third metallic layer, whereafter the third layer can be joined to the second metallic layer while joining the mesh to, and in between, the second and the third layers. The reversed order can also be applied. The joining of the three layers is suitably accomplished by means as above described.

Suitably, the third metallic layer is selected from Ag, Fe, Cu, Al, Ni, Cr, or alloys thereof, preferably from Ag, Fe. The thickness of the third layer is suitably from about 0.2 to about 10 mm, preferably from about 0.4 to about 5 mm.

Suitably, the thickness ratio between the second layer and the third layer is from about 100 to about 0.1, preferably from about 50 to about 5.

According to a variation of this preferred embodiment of the invention, a fourth layer is joined to, and in between, the third and the first metallic layers. The joining of the fourth layer is suitably performed by means of the joining methods as above described. The thickness of the fourth layer suitably is from about 0.2 to about 10 mm, preferably from about 0.4 to about 5 mm. The fourth metallic layer suitably is selected from Ag, Cu, Al or alloys thereof, preferably from Ag.

Generally, the term mesh is meant to include any net or network or net-like structure, e.g. foraminous sheet, screen, net, grid or network of threads or strands. The mesh is suitably selected from plastic materials, ceramics or the like as well as Fe, steel, hastelloy, Cu, Ag or alloys thereof, preferably from Fe or steel. The mesh suitably has a diamond, rhomboidal, or quadratical form or the like. The size of the mesh apertures can be from about 0.5 to about 10 mm, preferably from about 1 to about 5 mm. The thickness of the mesh is suitably from about 0.1 to about 5 mm, preferably from about 0.1 to about 1 mm.

The joining of the mesh can be performed in various ways. Suitably, the mesh is joined by means of explosion bonding, rolling, bolting or the like. Preferably, explosion bonding is used.

The invention further concerns a construction comprising at least two metallic layers; a first metallic layer, sensitive to hydrogen embrittlement, joined to a second metallic layer, and a mesh, providing venting channels between said first and second metallic layers, joined to, and in between, said first and second metallic layers. The construction can be produced by the method as above described.

The venting channels are capable of venting out hydrogen gas derived from recombined hydrogen atoms that have diffused into the construction via the second metallic layer. The venting channels prevent formation of hydrogen blisters at the interface surfaces between the second and the third metallic layers which otherwise would cause losses in strength in the construction or even cause the joint between the metallic layers to separate. The venting channels formed suitably have a diameter of from about 0.01 $\mu$m to about 1000 $\mu$m, preferably from about 0.1 $\mu$m to about 10 $\mu$m. Further, by the term "channel"; also pores, grooves, canals or other pathways are included.

Further characteristics of the metallic layers and the mesh of the construction suitably have dimensions and structures as above described.

The invention further concerns a construction obtainable from the method as described above.

According to one preferred embodiment, the construction also comprises a third metallic layer joined to, and in between, said first and second metallic layer. The mesh is, in this embodiment, joined to, and in between, the second and the third metallic layers.

According to one variation of the preferred embodiment, the first, the third, and the second metallic layers form an anode, a protecting intermediate layer, and a cathode respectively, thereby providing a bipolar electrode or the like. The channels formed suitably have a diameter from about 1 $\mu$m to about 100 $\mu$m.

The first metallic layer, i.e. the hydrogen-sensitive anode, is suitably selected from Ti, Zr or other valve metals or alloys thereof, preferably from Ti. The second layer, i.e. the cathode, being resistent to hydrogen, is suitably selected from Fe, steel, Cr, Ni or alloys thereof, preferably from steel. The third layer, i.e. the intermediate layer, being resistent to hydrogen, is suitably selected from Ag, Cu, Al or alloys thereof, preferably from Ag. The thickness of the first layer suitably is from about 2 to about 20 mm, preferably from about 5 to about 15 mm. The thickness of the second layer suitably is from about 2 to about 30 mm, preferably from about 5 to about 20 mm. The thickness of the third layer suitably is from about 0.2 to about 10 mm, preferably from about 0.4 to about 5 mm.

Suitably, the hydrogen permeability is higher in the second layer than in the third layer. Preferably, the ratio between the hydrogen permeability of the second layer and the third layer is from about $10^3$ to about $10^9$.

Suitably, the thickness ratio between the third layer and the mesh is from about 2 to about 20, preferably from about 4 to about 10.

According to a variation of this preferred embodiment, especially when the third metallic layer is selected from Fe, Ni, Cr or alloys thereof, a fourth layer is joined to the construction to further prevent hydrogen embrittlement of the first layer. The fourth metallic layer is joined to, and in between, the third and the first metallic layers. The fourth layer is suitably selected from Ag, Cu, Al or alloys thereof, preferably from Ag. The thickness of the fourth layer is suitably from about 0.2 to about 10 mm, preferably from about 0.4 to about 5 mm.

The bipolar electrode, particularly suitable for processes involving formation of hydrogen, e.g. when producing alkali metal chlorate, is thus provided for when joining the at least three metallic layers and the mesh as described above. In bipolar electrolytic cells, several assemblies of bipolar electrodes are normally connected electrically in series within one cell box. In order to obtain low ohmic losses and a uniform current distribution on the electrodes, the anodes and the cathodes, in adjacent cells, are connected "back to back" via a backplate. On one side of the backplate, an anode, corresponding to the first metallic layer, is mounted, enabling electron transfer as a consequence of the anodic reaction, e.g. by generation of chlorine occuring at the anode when the electrode is run in an electrolysis cell for the production of e.g. alkali metal chlorate, alkali metal hydroxide, or hypochlorite. On the other side of the backplate, a cathode, corresponding to the second metallic layer, is mounted enabling electron transfer as a consequence of hydrogen evolution ($H_2$) at the cathode.

The backplate connects the anode blades and the cathode blades electrically and mechanically. Hydrogen atoms, adsorbed on the cathode, are formed when hydrogen evolution takes place at the cathode. The majority of the hydrogen atoms formed recombines to form hydrogen gas. However, a small portion of the adsorbed hydrogen atoms diffuse into the cathode.

In a conventional bipolar electrode comprising cathode, backplate and anode, non-recombined hydrogen atoms can diffuse through the cathode, suitably constructed in Fe, towards the backplate. The backplate will prevent the majority of the hydrogen atoms from further diffusion through the backplate to the hydrogen sensitive anode, often constructed in Ti. At the interface between the cathode and the backplate, hydrogen atoms can recombine on structural defects and thereby start formation of hydrogen which in turn can lead to formation of hydrogen blisters.

The bipolar electrode of the present invention will effectively enable venting of hydrogen gas at the interface, i.e. the joint, between the cathode, the mesh and the protecting intermediate layer, via the formed venting channels, thus preventing formation of hydrogen blisters.

The invention also concerns an electrochemical cell comprising an electrode as above described. The electrochemical cell can be a bipolar cell, a multimonopolar cell or the like.

The invention also concerns the use of an electrochemical cell as above described for production of alkali metal chlorate, alkali metal hydroxide, hypochlorite or the like.

According to still another preferred embodiment of a construction, a mesh is joined to, and in between, the first and second metallic layers of the construction as above described. The joined construction according to this embodiment can, when exposed to relatively low-concentrated hydrogen environments, effectively protect the first layer from hydrogen embrittlement as well as provide for venting of formed hydrogen gas in the interface zone between the first and the second metallic layers. The first metallic layer, being a hydrogen-sensitive metal, is suitably selected from Fe, steel or alloys thereof, preferably from steel. The second metallic layer, being resistent to hydrogen, is suitably selected from Fe, steel, Ni, Cr or alloys thereof, preferably from steel. The thickness of the first layer suitably is from about 1 to about 20 mm, preferably from about 1 to about 10 mm. The thickness of the second layer suitably is from about 2 to about 20 mm, preferably from about 2 to about 15 mm. The construction is preferably used in moderately exposed hydrogen environments, such as for cathodic protection, off-shore applications, and in petrochemical industry.

DESCRIPTION OF THE EMBODIMENTS

Figure 1:
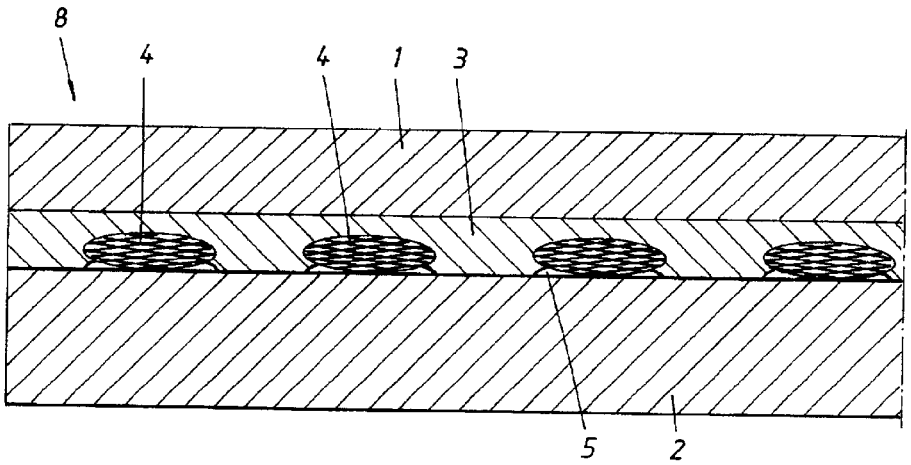
FIG. 1 is a side section view of a construction according to the invention.

Referring to the drawings, numeral 8 of FIG. 1 refers to a construction according to the invention. A first metallic layer 1 is joined to a third metallic layer 3, which in turn is joined to a second metallic layer 2. Between the second 2 and the third 3 layers, a mesh 4 is joined providing venting channels 5.

Figure 2:
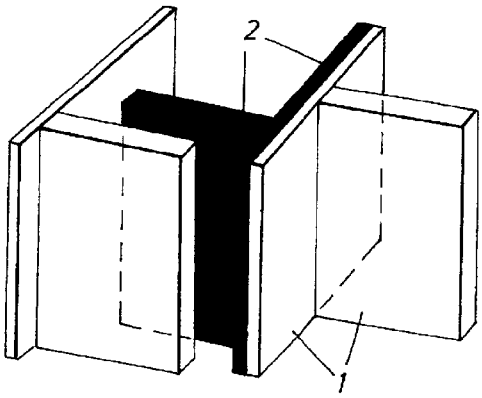
FIG. 2 is a perspective view of one embodiment showing a unit of a bipolar electrode arranged in an electrolytic cell (the mesh not shown).

FIG. 2 refers to one unit of bipolar electrodes, to be arranged in an electrochemical cell for production of sodium chlorate, comprising the construction according to FIG. 1. An anode 1 corresponds to a first metallic layer. A cathode 2 corresponds to a second metallic layer. From the shown embodiment of FIG. 2, it appears that a portion of the cathode (black) and the anode (white) protrudes perpendicularly from the construction structure as depicted in FIG. 1. The third metallic layer, here corresponding to the backplate, and the mesh are not shown. These two elements are mounted as shown in FIG. 1.

Figure 3:
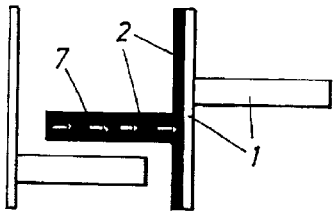
FIG. 3 is a side view of FIG. 2 showing hydrogen diffusion into the cathode (the mesh not shown).

FIG. 3 refers to the same bipolar electrode unit as does FIG. 2. The arrows 7 indicate the direction of diffusion of hydrogen atoms formed as intermediates at the cathode as a result of the hydrogen gas evolution in the cell.

It will be obvious that the same may be varied in many ways, the invention being thus described. Such variations are not to be regarded as a departure from the gist and scope of the present invention, and all such modifications as would be obvious to one skilled in the art are intended to be included within the scope of the claims. The following example will further illustrate how the described invention may be performed without limiting the scope of it.

EXAMPLE

Structural strength of backplate samples, i.e. the joined steel (cathode), silver (intermediate layer) and titanium (anode) layers, were measured before and after electrolysis, for production of sodium chlorate, for explosion bonded conventional electrodes without mesh and electrodes provided with mesh according to FIGS. 2 and 3. Explosion bonded samples were taken from different parts of the backplate to investigate the influence of poor bonding, which were analysed in small parts by ultrasonic analysis. The sample was 0.12 m×0.12 m×0.030 m of the backplate. The tests were run on the backplate samples in a four-unit chlorate cell. The temperature of the electrolyte was 65° C. and the current density through the backplate was about 3–5 $kA/m^2$.

In all the samples of the conventional electrodes, the structural strength after 10 days of electrolysis was lower than 1 MPa.

The samples provided with mesh maintained their original structural strength of about 190 MPa after 10 days of running in an electrolysis cell under the same conditions as the conventional backplate electrodes.

The results indicate that the backplates provided with mesh, providing venting channels, are not subjected to formation of hydrogen blisters in contrast to conventional backplate electrodes.

What is claimed is:

1. Construction comprising at least two metallic layers wherein a first metallic layer, sensitive to hydrogen embrittlement, is joined to a second metallic layer, and wherein a mesh, providing venting channels between said first and second metallic layers, is physically attached to, and in between, said first and second metallic layers, and wherein said venting channels are capable of providing venting between said first and second metallic layers.

2. Construction according to claim 1 wherein a third metallic layer is joined to, and in between, said first and second metallic layer, and wherein the mesh, is joined to, and in between, the second and the third metallic layers.

3. Construction according to claim 2 wherein a fourth metallic layer is joined to, and in between, the third and the first metallic layers.

4. Construction according to claim 1 wherein the channels formed have a diameter from about 0.01 $\mu$m to about 1000 $\mu$m.

5. Construction according to claim 1 wherein the first metallic layer is selected from the group consisting of Ti, Zr, Nb, Ta and alloys thereof.

6. Construction according to claim 2 wherein the first, the third, and the second layers form an anode, an intermediate layer, and a cathode providing a bipolar electrode.

7. Construction according to claim 2 wherein the hydrogen permeability is lower in the third layer than in the second layer.

8. Electrochemical cell characterized in that it comprises an electrode as defined in claim 6.

9. A construction for ventilation of hydrogen gas, obtained by a method comprising joining a first metallic layer, sensitive to hydrogen embrittlement, to a second metallic layer, and interposing therebetween said layers and physically attaching thereto, a mesh, said mesh forming venting channels for ventilation of hydrogen gas, and wherein said venting channels are capable of providing venting between said first and second metallic layers.

* * * * *